United States Patent [19]

Travor

[11] 4,094,246

[45] June 13, 1978

[54] FLUID STABILIZING INSERT FOR PROJECTILES

[75] Inventor: Bruce W. Travor, Holland, Pa.

[73] Assignee: The United States of America as represented by the Secretary of the Army, Washington, D.C.

[21] Appl. No.: 638,724

[22] Filed: Dec. 8, 1975

[51] Int. Cl.[2] ..... F42B 13/14
[52] U.S. Cl. ..... 102/66
[58] Field of Search ..... 102/6, 65, 66, 90; 244/3.24

[56] References Cited

U.S. PATENT DOCUMENTS

| | | | |
|---|---|---|---|
| 1,819,106 | 8/1931 | McBride et al. | 102/66 |
| 3,032,857 | 5/1962 | Lyon | 244/3.24 |
| 3,282,714 | 11/1966 | Wessells | 102/66 |

*Primary Examiner*—Verlin R. Pendegrass
*Attorney, Agent, or Firm*—Nathan Edelberg; Harold H. Card, Jr.; A. Victor Erkkila

[57] ABSTRACT

A spin stabilized projectile containing an annulus of incendiary liquid surrounding a burster tube, in which the liquid is compartmentalized to minimize rotational spin loss of the projectile due to centrifugal force effect on or anti-spin inertia by the liquid.

3 Claims, 4 Drawing Figures

FLUID STABILIZING INSERT FOR PROJECTILES

The invention described herein may be manufactured, used and licensed by or for the Government for governmental purposes without payment to me of any royalty thereon.

This invention relates to projectiles, and more particularly, to a spin stabilized projectile containing an incendiary liquid.

One of the objects of the invention is to provide a spin stabilized incendiary projectile in which the projectile rotational spin loss is minimized.

Another object of the invention is to provide such a projectile having a controlled liquid arrangement in which the centrifugal force effect on or anti-spin inertia by the liquid is minimized.

A further object is to provide such a projectile in which operational flight stability is not adversely affected by the presence of a liquid fill.

These and other objects, features and advantages will become more apparent from the following description and accompanying drawings in which.

Figure 1:
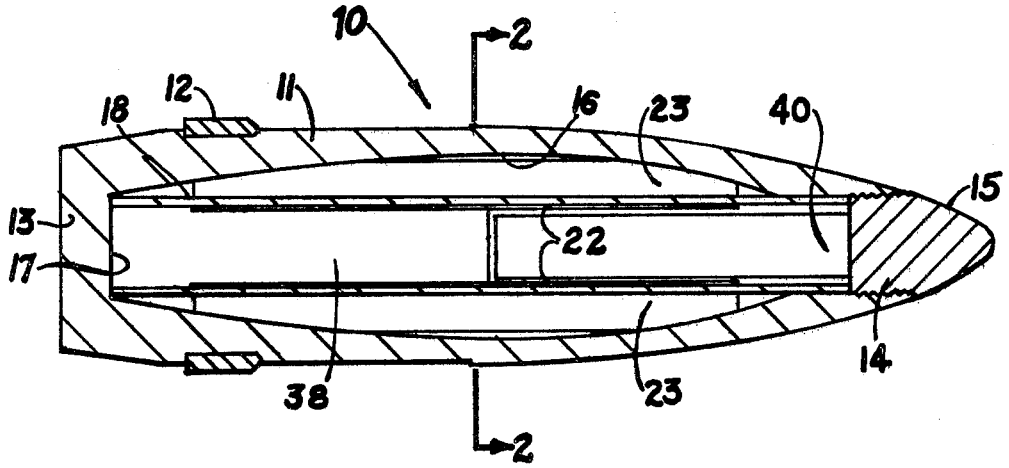
FIG. 1 is a longitudinal sectional view, taken along line 1—1 of FIG. 2, of a projectile embodying the principles of the invention.
Figure 2:
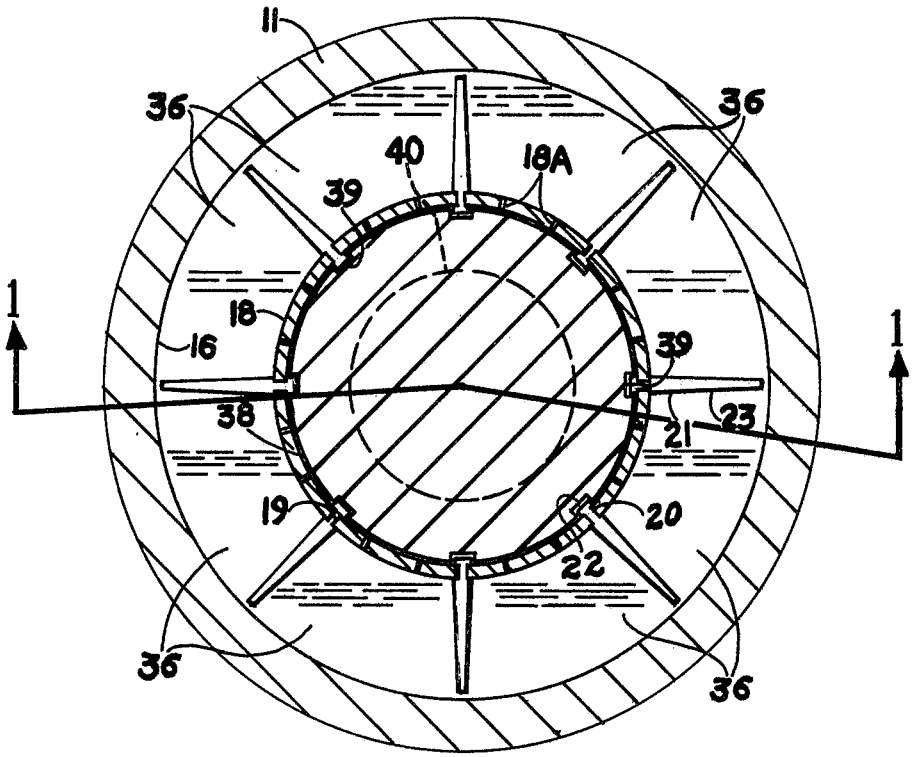
FIG. 2 is an enlarged sectional view taken along line 2—2 of FIG. 1.

The spin stabilized projectile, shown generally at 10 (FIG. 1), has a predeterminedly shaped housing or main projectile body 11, the peripheral side wall of which has an annular groove to accommodate a conventional spin imparting rotating band 12, and terminates in a closed integral rearward wall or base 13 and a central longitudinal opening or mouth that is at least partially threaded at 14 to securingly receive the threaded forward nose member 15 upon assembly. The interior cavity 16 within the housing 11 has a predetermined tapered contour at both the forward and rearward sidewall substantially annular surface portions thereof. Preferably, the rearward cavity sidewall surface portion terminates at a circular interior base surface 17 that has a diameter substantially equal to the diameter of the housing mouth, thus providing means for facilitatingly and firmly seating or positioning a predetermined length of cylindrical tubing 18 upon assembly. Tube 18 has a large number of spaced radial fluid passages 18A (FIG. 2) throughout its sidewall length and a plurality of circumferentially equally spaced, longitudianally extending slots 19, each slot being appropriately dimensioned to suitably seat or secure in place the neck portion 20 of a corresponding elongated blade member 21. Each blade member 21 has a head portion 22, a tapered blade portion 23 and an intermediate or interconnecting neck portion 20.

Figure 3:
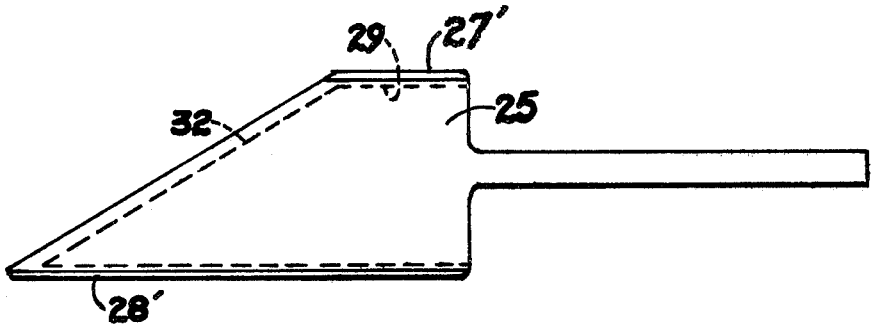
FIG. 3 is an elevational view of an associated assembly insert tool.
Figure 4:
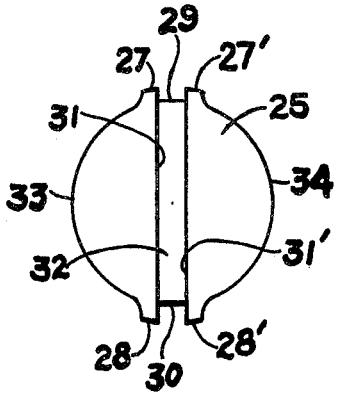
FIG. 4 is an enlarged front end view of the FIG. 3 tool.

During assembly of the projectile components, successive blade members 21 are cammed or inserted into their respective slots 19 by an appropriate insert tool 25 (FIGS. 3, 4). The cylindrical tool 25 has corresponding upper and lower pairs of longitudinally extending protruding surfaces 27,27' and 28,28', with each pair being laterally spaced by a respective groove 29,30. The inclined front surface of solid cylindrical tool 25 has a pair of opposed surfaces 31,31' that are laterally spaced by inclined groove 32 and constructed or formed such that each inclined surface 31 and 31' is substantially vertically aligned with and interconnects the corresponding inner edges of protruding surfaces 27 and 28, and 27', respectively, and that inclined grooved surface 32 is substantially vertically aligned with and interconnects groove surfaces 29 and 30.

The tool surfaces have predetermined dimesions such that the substantially diametrically opposed protruding surfaces 27,27', 28,28' are slidingly receivable within the internal surface of the forward end of cylinder 18 as the tool grooves 32 and 29 cam and seat a selected blade member 21 into its predetermined and manually aligned slot 19. Groove surface 30, which is substantially diametrically opposed to groove 29, and the predeterminedly dimensioned tool cylindrical peripheral surface portions 33,34 facilitatingly accommodate the head portions 22 of previously inserted blade members 21 without interference during assembly.

The blade members or contoured ribs 21 have predeterminedly shaped blade tips or thin edges that preferably, upon assembly, substantially abut a major portion of the cavity sidewall at substantially equally and circumferentially spaced locations to thus provide a cellular structure defining a plurality of elongated chambers 36 between adjacent blade members 21 for filling with an incendiary liquid or the like. After the contoured ribs 21 have been installed and a predetermined amount of the liquid has been poured into the mouth of an upstanding projectile housing 11, a cylindrical aluminum honeycomb fill 38, having suitably spaced longitudinal peripheral grooves 39, is inserted and positioned in the rearward portion of tube 18 within the liquid, prior to installation of nose member 15 and burster tube 40 which had been suitably secured to the nose.

Upon launching of the spinning projectile, the substantially compartmentalized liquid in the elongated chambers 36 is substantially precluded by the contoured ribs 21 of the controlled liquid arrangement from receiving an adverse or anti-spin inertia effect which might otherwise be caused by the centrifugal force of the spinning projectile. As a result, the projectile rotational spin loss is minimized and operational flight stability is not adversely affected.

Various modifications, alterations or changes may be resorted to without departing from the scope of the invention as set forth in the appended claims.

I claim:

1. In a spin stabilized projectile having a main projectile body and a forwarded nose member secured thereto, said body containing a burster tube and a controlled liquid arrangement for minimizing rotational spin loss of the projectile, a cellular structure within said body and extending radially outward of said burster tube, said cellular structure having a plurality of longitudinally extending contoured ribs defining elongated chambers containing portions of said liquid, said cellular structure including a substantially cylindrical slotted tube surrounding said burster tube, the sidewall of said slotted tube having a plurality of circumferentially spaced longitudinally extending slots, each of said ribs having a head portion, a blade portion and an intermediate reduced neck portion, each of said neck portions extending longitudinally within a corresponding one of said tube slots, each of said rib head portions having a width larger than that of its corresponding slot and each head portion extending inwardly adjacent to its corresponding slot.

2. The structure in accordance with claim 1 wherein each of said rib blade portions has opposed tapered sidewalls that inwardly terminate adjacent their corresponding reduced neck portion.

3. The structure of claim 2 wherein each of said rib tapered blade portions terminate outwardly in relatively thin edges adjacent an internal wall of said projectile body.

* * * * *